US005471288A

United States Patent [19]

Ohtsuka et al.

[11] Patent Number: 5,471,288

[45] Date of Patent: Nov. 28, 1995

[54] IMAGE HEATING APPARATUS AND HEATING FILM

[75] Inventors: Yasumasa Ohtsuka, Yokohama; Yohji Tomoyuki, Ichikawa; Hideyuki Hatakeyama, Yokohama, all of Japan

[73] Assignee: Canon Kabushiki Kaisha, Tokyo, Japan

[21] Appl. No.: 206,851

[22] Filed: Mar. 7, 1994

[30] Foreign Application Priority Data

Mar. 5, 1993 [JP] Japan ..... 5-069059
Jul. 8, 1993 [JP] Japan ..... 5-169201

[51] Int. Cl.[6] ..... G03G 15/20

[52] U.S. Cl. ..... 355/285; 219/216

[58] Field of Search ..... 355/285, 289, 355/290; 219/216, 388; 428/473.5; 432/60

[56] References Cited

U.S. PATENT DOCUMENTS 5,177,549 1/1993 Ohtsuka et al. ..... 355/284
5,182,606 1/1993 Yamamoto et al. ..... 355/289
5,196,675 3/1993 Suzuki et al. ..... 219/216

OTHER PUBLICATIONS

English Abstract of Japanese Patent Document 01–187582, published Jul. 26, 1989.

English Abstract of Japanese Patent Document 63–313182, published Dec. 21, 1988.

*Primary Examiner*—R. L. Moses
*Attorney, Agent, or Firm*—Fitzpatrick, Cella, Harper & Scinto

[57] ABSTRACT

An image heating apparatus includes a heater; a movable film having a first surface in contact with the heater and a second surface contactable with a recording material supporting a toner image; heating a toner image on a recording material by heat from the heater; the film comprising an insulative base layer chargeable to a polarity opposite from the of the toner and an electrically conductive layer at a position closer to the insulative base layer.

39 Claims, 7 Drawing Sheets

IMAGE HEATING APPARATUS AND HEATING FILM

FIELD OF THE INVENTION AND RELATED ART

The present invention relates to a heating film for heating a toner image on a recording material and an image heating apparatus for heating a toner image on a recording material with heat from a heater through a film.

As for a heating apparatus for heating a recording material to fix an image or the like, a heat roller type is widely used which comprises a heating roller maintained at a predetermined temperature and a pressing roller having an elastic layer to pre-contact the recording material to the heating roller, in which the recording material is passes through the nip formed between the rollers.

Japanese Laid-Open Patent Application No. 313182/1988 which has been assigned to the assignee of this application has proposed an image fixing apparatus which comprises a stationarily supported heater (thermal heater), a heat resistive film (fixing film) moved in press-contact with the heater and a pressing member for pressing the recording material to the heater through the film interposed therebetween, in which the heat of the heater is applied to the recording material through the film, by which the unfixed image on the surface of the recording material is heated and fixed.

However, even in the film heating type fixing apparatus, toner offset occurs due to electrostatic factors. This is particularly remarkable when the toner charged to the negative polarity is heated.

In view of this, Japanese Laid-Open Patent Application No. 187582/1989 proposes that a parting layer of the film contactable to the toner image is reduced in the resistance, and the parting layer is electrically grounded to lower the surface potential of the film, thus preventing deposition of foreign matters and disturbance of the toner image.

However, with this structure, there are following problems. First, the toner offset has not been completely prevented. The inventors' investigations have revealed that the inside of the film is strongly charged to the positive polarity, and the positive potential thereby influenced to the toner bearing surface of the film, and therefore, the electrostatic force exist between the toner having the opposite polarity.

As another problem, when the resistance of the surface of the parting layer of the film is reduced, the transfer charge of the polarity opposite to that of the toner supported on the recording material leaks to the parting layer when the recording material absorbs moisture and therefore has low resistance. If this occurs, the electrostatic attraction force between the recording material and the toner does not apply with the result of easy toner offset tendency. If the resistance of the recording material is significantly reduced, the transfer current flows through the recording material into the parting layer with the result of central void of transfer image. Particularly when the paper has a basis weight of not more than 100 g/m$^2$ or when it absorbs moisture, the resistance of the paper lowers with the result of the above-described phenomenon which is remarkable.

SUMMARY OF THE INVENTION

Accordingly, it is a principal object of the present invention to provide an image heating apparatus and a heating film with which the toner offset due to the charging of the film is prevented.

It is another object of the present invention to provide an improved image heating apparatus having an insulating base layer and an electroconductive layer disposed at a toner image side of the insulative base layer.

It is a further object of the present invention to provide an image heating apparatus and heating film in which the toner Offset due leakage of electric charge of the recording material is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 2:
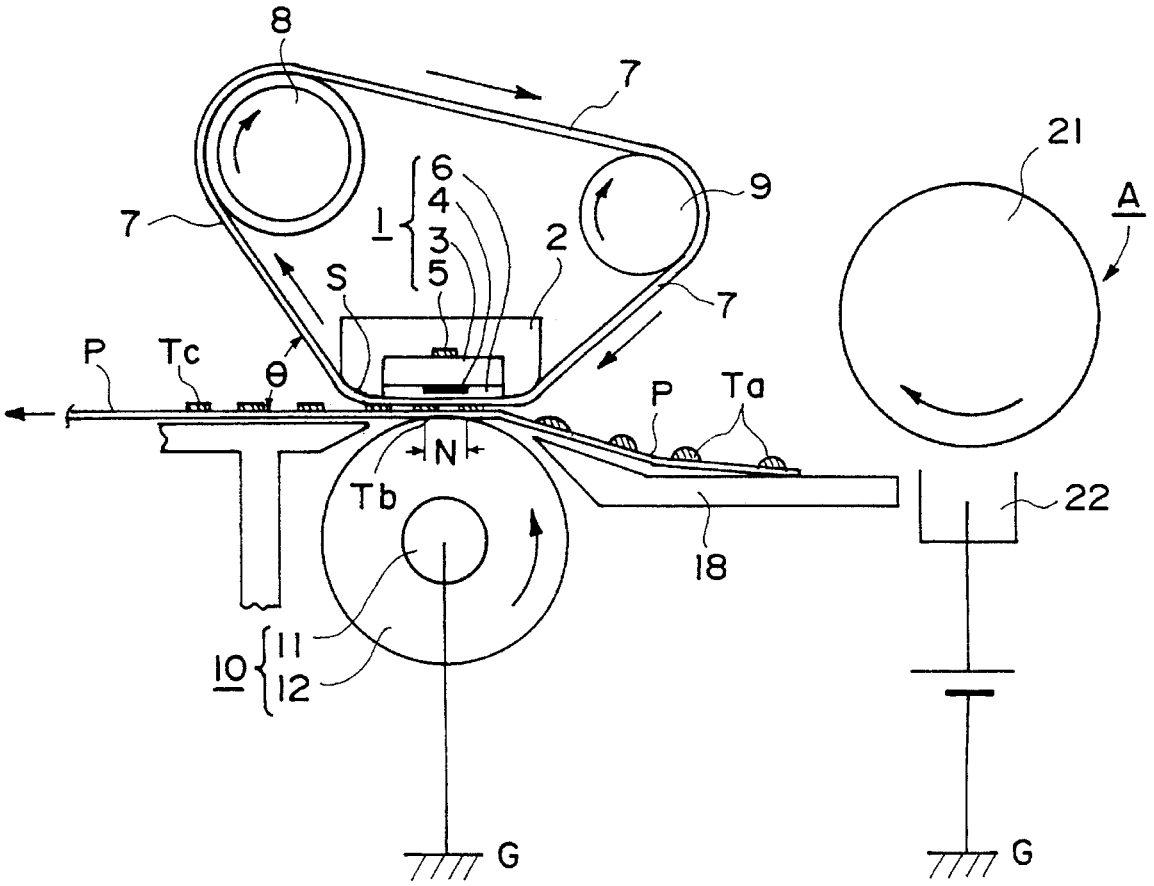
FIG. 2 is a sectional view of a major part of an image forming apparatus using an image heating apparatus.

Referring to FIG. 2, there is shown an image forming apparatus having an image heating apparatus in the form of an image fixing apparatus according to an embodiment of the present invention.

A developed image formed on a photosensitive drum 21 in an image forming station A, is transferred onto a recording material P by applying positive charge (opposite from the polarity of the charge of the toner) to the backside of the transfer material P by transfer charging 22. The transferred toner image Ta is electrostatically supported on the surface of the recording material. The recording material is conveyed into an image fixing apparatus wherein it is heated and fixed. A distance between the transfer station and the fixing station are shorter than the maximum length recording material usable with the image forming apparatus.

An image fixing film (heating film) 7 in the form of an endless belt of heat resistive property, is extended around three members, namely, a left driving roller 8, a right follower roller 9, and a low thermal capacity line heater 1 disposed below between the rollers 8 and 9. The fixing film 7 and the heater 1 are contacted, and the film slides relative to the heater when the fixing film 7 moves.

The follower roller 9 functions as a tension roller for the endless belt fixing film 7. The fixing film 7 is rotated without delay, crease or snaking motion at the same peripheral speed as the conveying speed of the recording material (transfer sheet) P carrying on its upper surface an unfixed toner image Ta, in the clockwise direction, by the clockwise rotation of the driving roller 8.

Designated by a reference numeral 10 is a pressing roller (pressing member) comprising a core metal 11 of steel or stainless steel material and a rubber elastic layer 12 of high parting property, such as silicone rubber or the like. It is pressed toward the bottom surface of the heater with the bottom travel portion of the fixing film 7 interposed therebetween, by an unshown urging means at a total pressure of 4–12 kg. It rotates about an axis 11 in the counterclockwise direction, that is, co-directionally with the recording material P. The core metal 11 is electrically grounded for prevention of noise production.

The heater 1 extends in a direction crossing with the surface movement direction of the film 7 and comprises a heater base 3, heat generating resistor (heat generating element) 4, a temperature sensor 5. It is securedly mounted on a heater support 2.

The heater support 2 is of heat-insulative, high heat resistance and rigid material to support the heater 1 with thermal insulation from the fixing apparatus and the entirety of the image forming apparatus.

The heater base 3 is of heat-resistive, insulative and low thermal capacity member. An example thereof has a thickness of 1.0 mm, a width of 10 mm and a length of 240 mm and is made of alumina plate.

In response to image formation start signal, an image forming station A operates to form an unfixed toner image Ta on a recording material, which is conveyed into an image fixing device along a guide 18. It is introduced into between the fixing film 7 and the pressing roller 10 in a fixing nip N formed between the heater 1 and the pressing roller 10. The toner image bearing surface are in close contact with the bottom surface of the fixing film 7 which is rotating at the same peripheral speed and in the same peripheral direction as the recording material P, without deviation therebetween, crease or lateral shift, That is, heating the overlaid relation with the fixing film 7. The heater 1 is actuated at predetermined timing relative to the image formation starting signal so that the toner image Ta is heated in the nip N into a softened and/or fused image Tb.

The moving direction of the fixing film 7 is abruptly changed at an acute angle (θ=approx. 45 deg.) at an edge S of the supporting member 2 having a large curvature (radius of curvature is approx. 2 mm). Therefore, the recording material P moving together with the fixing film 7 is separated from the fixing film 7 by the curvature at the edge S, and is discharged to a discharging tray. By the time it is discharged, the toner is sufficiently cooled and solidified, and is completely fixed on the recording material as a fixed toner image Tc.

In this embodiment, the thermal capacities of the heat generating element 3 and the base 3 of the heater 1 are small, and they are supported with thermal insulation by the support 2, and therefore, the surface temperature of the heater in the nip N is quickly increased to a temperature sufficiently high relative to a toner fusing point (fixable temperature to the recording material F). Therefore, the pre-heating (stand-by temperature control) for the heater 1 is not required, so that the energy can be saved and that the temperature rise inside the apparatus can be prevented.

The heat generating element 4 is of resistor material such as Ag/Pd (silver-palladium), $Ta_2N$ or the like extended along the length of the bottom surface of the base 3 substantially at the center thereof, that is on the surface faced to the film 7. The material is applied thereon through screen printing or the like into a thickness of approx. 10 μm and width of 1–3 mm. The top thereof is coated with a surface protection layer of heat resistive glass having a thickness of approx. 10 μm.

The temperature sensor 5, for example, is a temperature sensing material of low thermal capacity material such as Pt film or the like applied through the screen printing or the like generally at the center of the top surface of the base 3 (the surface opposite from that having the heat generating element 4). Temperature sensor element may be a low thermal thermistor contacted to the base 3.

The heater 1 is supplied with electric power G at the longitudinal ends thereof so that the entirety of the heater 4 generates heat. The electric power supply to the heat generating element 4 is controlled by an unshown control circuit including TRIAC in accordance with the temperature detected by the temperature sensor 5 so as to maintain 5 predetermined fixing temperature detected by the temperature sensor 5.

The description will be described as to the fixing film 7 (heating film).

Figure 1:
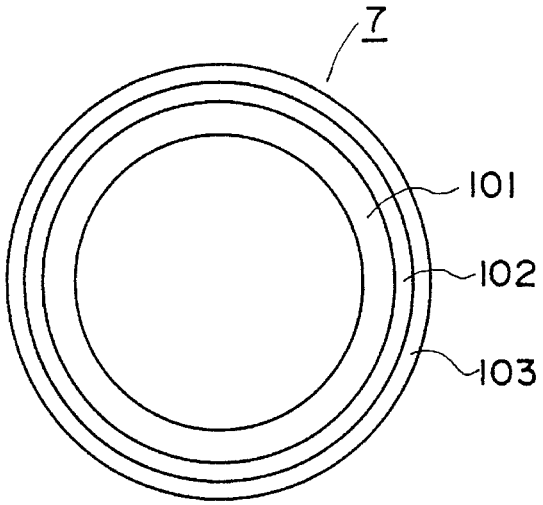
FIG. 1 is a sectional view of a heating film according to an embodiment of the present invention.

FIG. 1 shows a laminated structure of the fixing film.

An insulative resin base material 101 has a thickness of 20–80 μm and a volume resistivity of $10^{11}$ Ω.cm or more, and is of heat-resistive polyimide (insulative base layer).

A parting layer 103 of fluorine resin such as PFA or PTFE or the like or silicone resin material which has high insulative and parting property and has a volume resistivity of $10^{11}$ Ω.cm or more and a thickness of 5–20 μm, is bonded to the base material 101 through a primer layer 102 having a surface resistance of $10^7$ Ω/□ or lower and a thickness of 3–8 μm.

In this embodiment, a primary layer 102 having a surface resistance of $5\times10^4$ Ω/□ and thickness of 6 μm is sprayed on a polyimide film 101 having a volume resistivity of $10^{14}$ .cm and a thickness of 40 μm, and a fluorine resin (PFA:PTFE is 75:25) is sprayed thereon with a thickness of 10 μm. The volume resistivity of the fluorine resin layer is $10^{12}$ Ω.cm.

As will be understood, in this embodiment, the film base material 101 for sliding contact with the heater is insulative.

If the base material, 101 is added with electrically conductive material to reduce the electric resistance in an attempt to lower the triboelectric charge potential of the inside of the film, the problem of the current leakage would arise because the distance between the electric resistance material to be supplied with electric energy is very small.

If the thickness of the protection layer is increased, the quick-start advantage is influenced.

When the conductive material is mixed into the base material, the strength of the film decreases.

For these reasons, the base material 101 of the film is made insulative in this embodiment. Then, the base material 101 is strongly charged to the positive polarity which is the opposite from that of the toner, due to the triboelectric charging with the friction relative to the heater or the like.

Accordingly, measures are taken against the electrostatic attraction force to the toner provided by the charge potential of the sliding surface of the film.

More particularly, an electrically conductive layer 102 is provided on the film base 101 at a side closer to the toner.

Figure 3A:
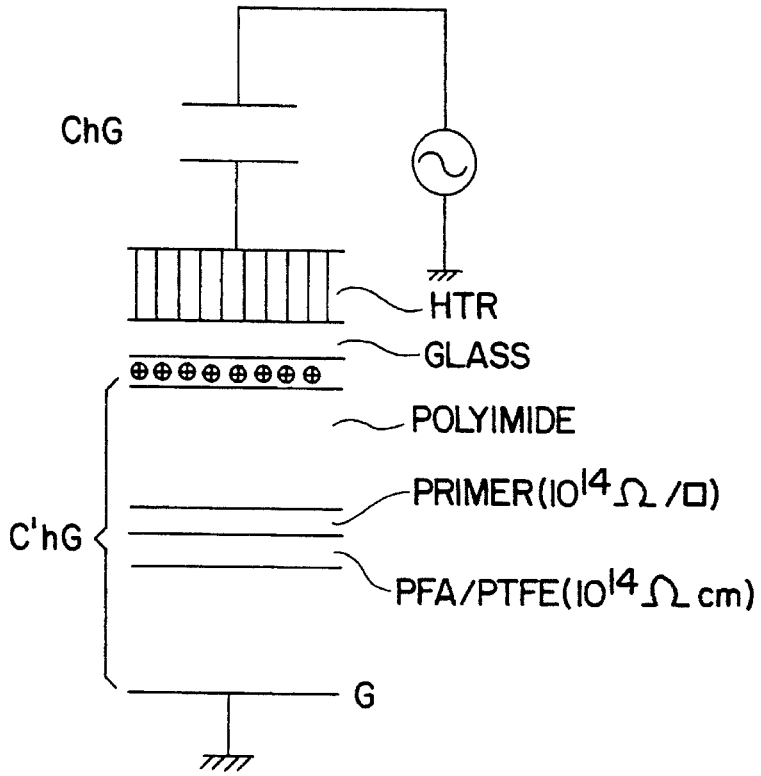
FIG. 3 shows equivalent circuit diagrams explaining the present invention, in which (a) represents a comparison example, and (b) represents the present invention.
Figure 3B:
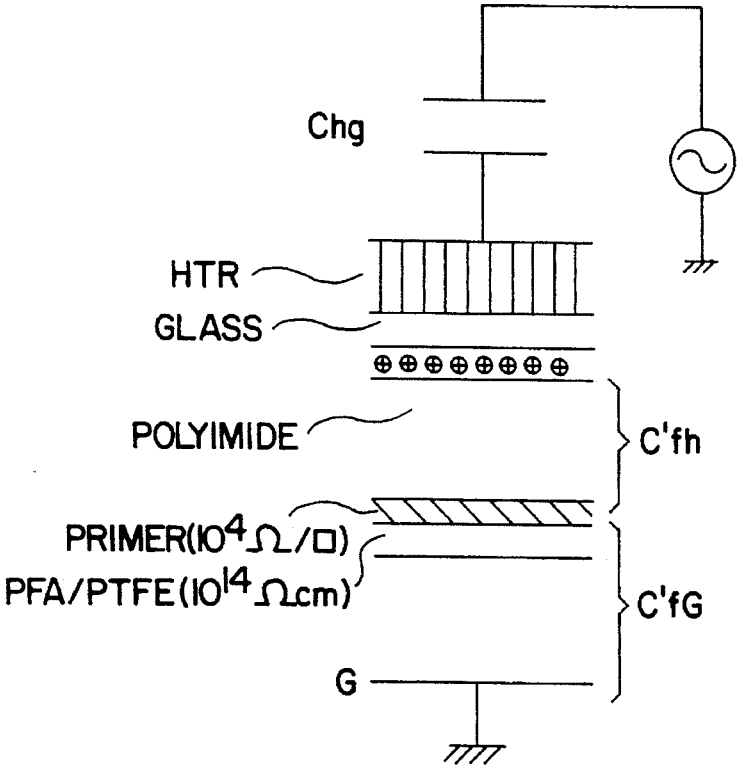

This is shown in FIG. 3. In this Figure, (a) represents a case of a film comprising the insulative polyimide base and an insulative fluorine resin of PFA and PTFE, bonded thereon with insulative primary, (b) represents a case of a film according to this embodiment shown in FIG. 1.

In FIG. 3, (*a*), ChG is a capacity in the circuit between the heater and the ground; C'hG is a capacity between the film and the ground. In FIG. 3, (*b*) ChG is a capacity in the circuit between the heater and the ground; C'fH is a capacity between the polyimide material and the primer; and C'fG is a capacity between the primer and the ground.

In FIG. 3, (*a*) the electric field provided by the positive charge on the inside surface of the film is directed toward the recording material through the polyimide material, primer and PFA/PTFE layer, and therefore, it electrostatically attracts the toner on the recording material.

As will be understood from FIG. 3, (*b*), according to this embodiment, the electric field generated by the triboelectric charge on the inside surface of the film is shielded by the primer layer having the electroconductive property, and no toner attraction force is produced.

The potential by the triboelectric charge (charge quantity is Q) on the inside surface of the polyimide material induces negative charge on the heater surface, and the inside surface of the primer, and the positive charge is generated on the outer surface of the primer. However, the charge amount Q' on the outer surface of the primer is the one dividedly induced with the heater, and therefore, the charge amount Q' is smaller than the charge amount Q. In addition, the capacity between the primer and the ground (C'fG) is about 100 pF, and therefore, the potential produced by Q' is small.

Table 1 shows the relationship among the surface potential of the sheet, the surface potential of the film and the toner offset when three different films are used.

layer (primer layer in Embodiment 1, and parting layer in Embodiment 2).

In this manner, according to Embodiments 1 and 2, the provision of the electroconductive layer at the toner side beyond the insulative base is effective to shield the electric potential provided by the triboelectric charge potential on the inside surface of the insulating base layer, and therefore, the toner offset can be prevented.

In Embodiment 2, the toner offset preventing property decreases as compared with the case of Embodiment 1, under a high humidity and high temperature condition. As shown in FIG. 2, in an image forming apparatus having an electrostatic transfer step, an unfixed toner transferred onto the recording material from the image bearing member by transfer charging means is strongly attracted on the recording material through electrostatic force due to the transfer charge of the polarity opposite to that of the unfixed toner injected to the backside of the recording material and the electric charge of the unfixed toner.

Under the high humidity and high temperature condition, the resistance of the recording material decreases. In Embodiment 2, the transfer charge of the polarity opposite to that of the toner given to the recording material P for electrostatically retaining the toner on the recording material P (positive in this embodiment) escapes into the electroconductive parting layer, and therefore, the electrostatic attraction force between the toner and the recording material decreases with the result of greater tendency of the toner offset occurrence.

In view of the above, it is further preferable that, as in Embodiment 1, the toner side surface of the film is of insulative layer to prevent the leakage of the transfer charge, and the potential due to the triboelectric charge potential one the inside surface of the base by the electroconductive layer in the film inside, is shielded.

The toner side surface of the film is slightly charged by the triboelectric charging with the recording material.

Therefore, it is preferable that the parting layer is of a material whose polarity is the same as the toner upon triboelectric charging with the recording material.

In the case of the toner charged to the negative polarity,

TABLE 1

| | Film | Sheet potential before nip (V) | | Sheet potential after nip (V) | | Film surface potential | Offset | |
|---|---|---|---|---|---|---|---|---|
| | | L.L. | H.H. | L.L. | H.H. | (V) | L.L. | H.H. |
| Comp. Ex. 1 | Base layer: polyimide, 45 μm<br>Primer layer: $10^{14}$ Ω/□<br>Parting layer: PTFE/PFA $10^{14}$ Ωcm | +500 | +400 | +500 | +400 | ≧+3.3 KV | N | N |
| Emb. 1 | Base layer: polymide, 45 μm<br>Primer layer: $10^{4}$ Ω/□<br>Parting layer: PTFE/PFA $10^{14}$ Ωcm | +500 | +400 | +400~480 | +300~380 | +50~300 | G | G |
| Emb. 2 | Base layer: polyimide, 45 μm<br>Primer layer: $10^{14}$ Ω/□<br>Parting layer: PTFE/PFA $10^{6}$ Ωcm | +500 | +400 | +200~270 | +10~30 | +10~30 | G | F |

(L.L.: 15° C., 10%, H.H.: 32.5° C., 85%)
G: No offset
F: slight offset
N: Offset As show in this table, the positive triboelectric charge of the polyimide is not less than +3.3 KV in the Comparison Example as a result of significant influence to the extent of the toner side surface of the film, in the Embodiments 1 and 2 of this invention, the influence does not extent to the surface due to the shielding effect of the electroconductive the parting layer is preferably fluorine, silicone resin or rubber.

In this embodiment, the conductive intermediate layer 102 is a primer layer having a low surface resistance, but an additional intermediate conductive layer of polyether sulfone resin added with several % of fluorine resin and carbon black, may be used.

If the surface resistance of the conductive intermediate layer is larger than $1\times10^7$ Ω/□, non-uniform charge distribution occurs in the fixing film inner surface through the triboelectric charge. If this occurs, a potential distribution arises in the electroconductive intermediate layer, and as a result, the electric field on the fixing film surface is non-uniform with the result of scattering of the toner image. This may result in toner offset because of the insufficient fixing of the fine toner around the image pattern. For this reason, the surface resistance thereof is preferably $1\times10^7$ Ω/□ or lower.

When the primer layer is of conductive layer, the bonding force reduces if the resistance is too low, and it is preferably not less than $10^2$ Ω/□.

A further embodiment will be described in which the parting layer 103 is of insulative property as in Embodiment 1, and the surface potential during the continuous image forming operation is further reduced.

Figure 4:
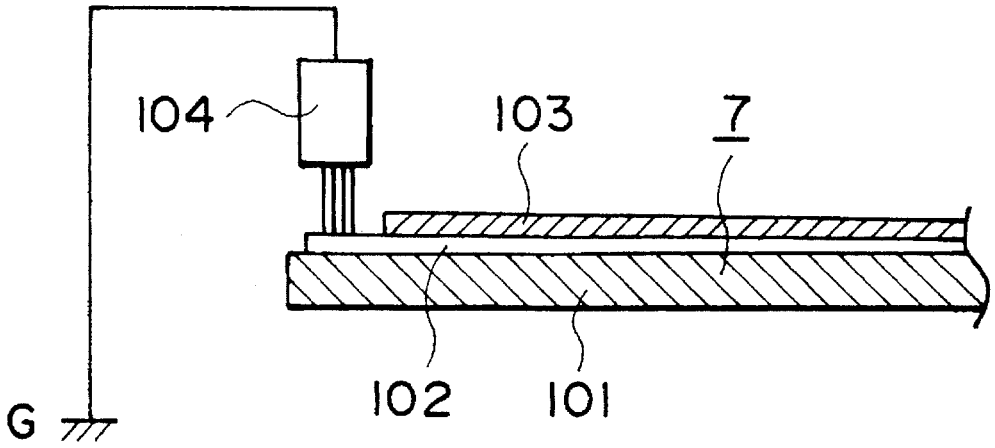
FIG. 4 is a sectional view of a heating film according to another embodiment of the present invention.

In this embodiment, as shown in FIG. 4, an end portion of the film 7 is provided with a region which is not coated with the parting layer 103. Through this portion, the electric connection is established with the conductive layer 102 through a conductive brush 104 to connect it to the ground. Thus, the potential of the intermediate layer 102 is always 0 V. The influence of the positive charge on the inside surface of the film is removed by the shielding effect, and therefore, the surface potential of the film is approx. 0 V.

The film 7 may be supported in the same manner as in Embodiment 1, as shown in FIG. 2.

According to this embodiment, the surface potential of the film is further reduced and stabilized.

Figure 5:
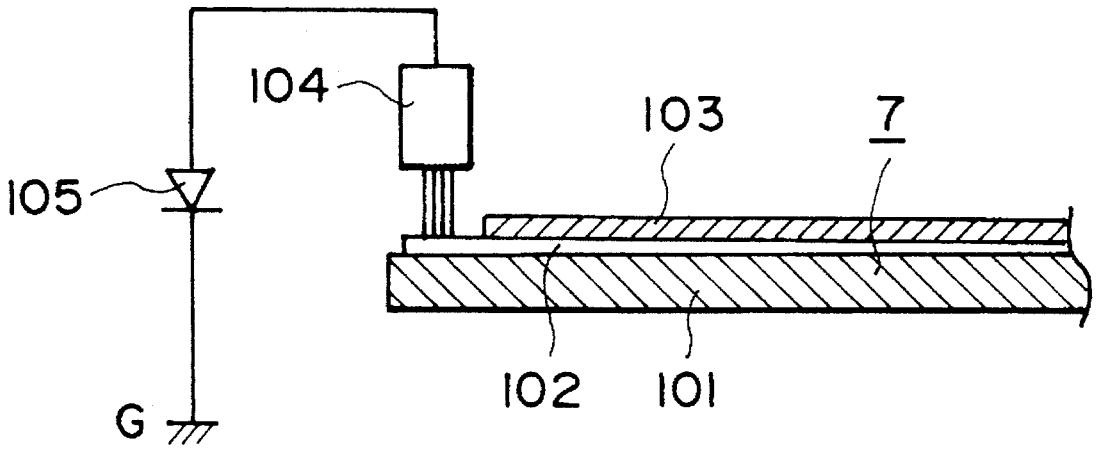
FIG. 5 is a sectional view of a heating film according to a further embodiment of the present invention.

FIG. 5 shows a further embodiment in which the grounding is effected through a rectifying element 105 to increase the margin of the toner offset to the film. According to this embodiment, the negative charge which is the same as that of tile toner is accumulated in the intermediate layer 102, by which the potential of the intermediate layer 102 is 0—several tens V. Then, the surface potential of the parting layer is influenced by this potential to increase to—several tens V, and therefore, the film potential result in an electric field which less produces the toner offset.

The rectifying element itself has a capacity of several pF, and therefore, the negative potential is produced at the cathode side by electrically grounding the anode side thereof. This is also effective to prevent the toner offset by the repelling force to the negatively charged toner, because the surface of the fixing film 7 has the negative potential.

In this embodiment, the description has been made with respect to the toner chargeable to the negative polarity. The same advantageous effects are provided in the case of an image forming apparatus in which the toner charged to the positive polarity is transferred onto the recording material using negative charge.

Figure 6:
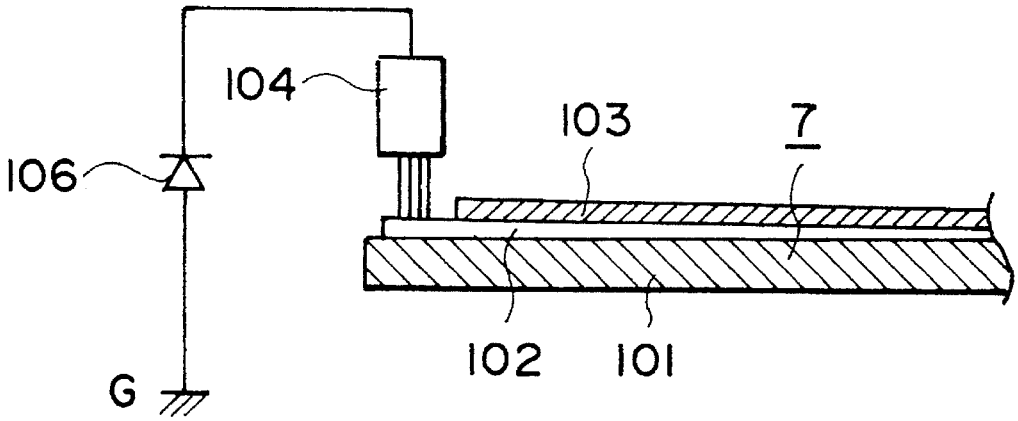
FIG. 6 is a sectional view of a heating film according to a further object of the present invention.

However, when the conductive layer 102 is grounded through a diode, the connection thereof is such that the positive charge is accumulated in the conductive layer, as shown in FIG. 6.

The description has been made as to the case in which the charge polarity of the inside surface of the film and that of the toner charging polarity are opposite from each other. When they are the same, it is preferable to shield the electric field by the conductive intermediate layer if the toner scattering occurs due to too high repelling potential relative to the toner.

In the foregoing embodiments, the insulative parting layer is used to prevent the leakage of the electric charge of the recording material.

A further embodiment of the present invention will described in which the toner offset due to the electric charge caused by separation charging occurring on the film surface when the recording material is separated from the film, is prevented.

FIG. 1 is a sectional view illustrating a laminated structure of the fixing film 107. The insulative resin base layer 110 is in the form of a tube of heat resistive resin material such as polyimide, PFA, PTFE or the like having a volume resistivity of not less than $10^{14}$ Ω.cm and having a thickness of 20–80 μm.

Among these materials, the polyimide resin is preferable from the standpoint of mechanical strength. However, the polyimide resin is charged to the positive polarity which is the opposite from the polarity of the toner, by the friction with the heater 1.

A conductive layer 108 has a surface resistance of $10^7$ Ω/□ or lower and includes a mixture of polyimide resin, PFA resin or the like materials added with conductive carbon, and functions as a primer layer for bonding a parting layer 109 to the base layer 110.

When the primer layer is electrically conductive, the bonding strength decreases if the content of the conductive material is too large, and therefore, the surface resistance is preferably not less than $10^2$ Ω/□.

By the provision of the conductive layer 108, the charge potential of the inside surface of the base layer 110 is shielded so that the outer peripheral surface of the film is not influenced by the inside charge potential.

If the surface resistance of the conductive layer exceeds $10^7$ Ω/□, the shielding effect is insufficient, and in addition, the offset preventing effect due to the electrostatic attraction force between the toner and the potential inside the film, is also insufficient.

The parting layer 109 comprises heat resistive resin such as PFA, PTFE or a mixture thereof and low resistance material such as conductive carbon so as to provide the surface resistivity of $10^8$ Ω/□–$10^{11}$ Ω/□. According to this embodiment, the surface parting layer 109 also contains the conductive carbon, but the surface resistance of the conductive layer 108 is smaller than that of the surface parting layer 109.

On the other hand, if the resistance of the surface parting layer is not more than $10^8$ Ω/□, the transfer charge leaks through the paper with the result of toner offset, or, under a high humidity condition, the transfer current leaks with the result of central void on the transferred image. If it is not less than $10^{11}$ Ω/□, conversely, the electric charge generated on the film surface due to the separation charge is not easily attenuated by flowing into the ground or by expanding in the conductive layer, and therefore, the offset is produced.

In the experiments, the primer layer 108 comprised conductive carbon black (Rion Paste W-310A, available from Rion Kabushiki Kaisha), the weight percentage thereof being 1–4% (solid component), thus providing the electroconductivity. The parting layer comprised 0.4–1% by weight of the same conductive carbon black (solid component ratio) in a base mixture of PFA and PTFE resin (20:80). The results were good in all of toner-offset prevention, toner scattering preventing and central transfer void prevention. On the other hand, when the content of the carbon black of the primary layer is less than 1% by weight, the shielding effect is insufficient. If it is larger than 4% by weight, the cost of the resin material is high, and the film strength is decreased, with the result of insufficient function and a primer. In the case of the parting layer, if the content of the carbon black is less than 0.4% by weight, the attenuation of the charge provided by the separation, is not enough, with the result of toner offset. If it is larger than 1.0% by weight, the resistance is too low, and the toner offset or the central transfer void occurs due to the leakage of the transfer charge.

In order to further increase the shielding effect, the conductive layer is electrically connected.

Figure 8:
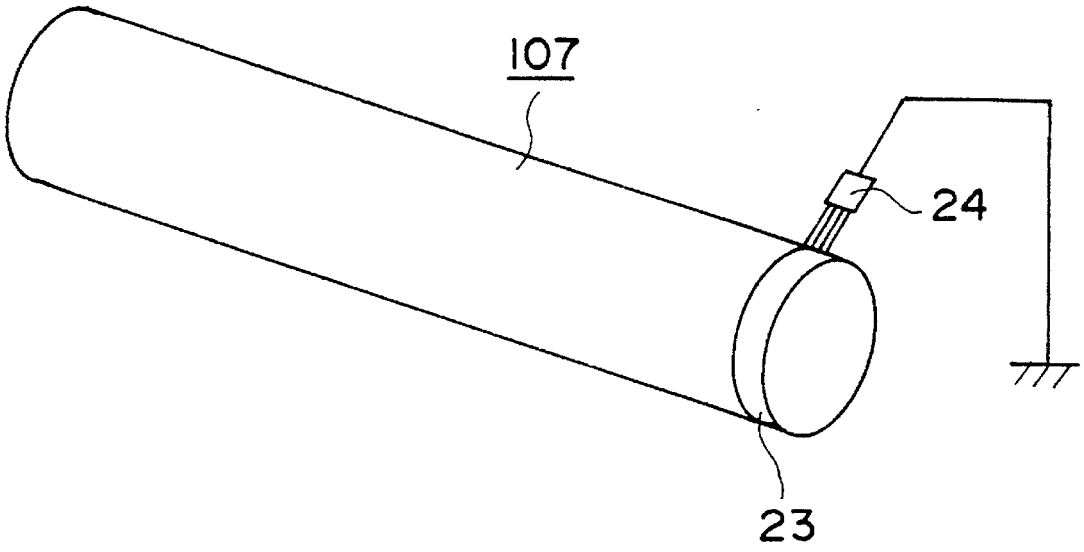
FIG. 8 illustrate electric connection in the film according to an embodiment of the present invention.
Figure 9:
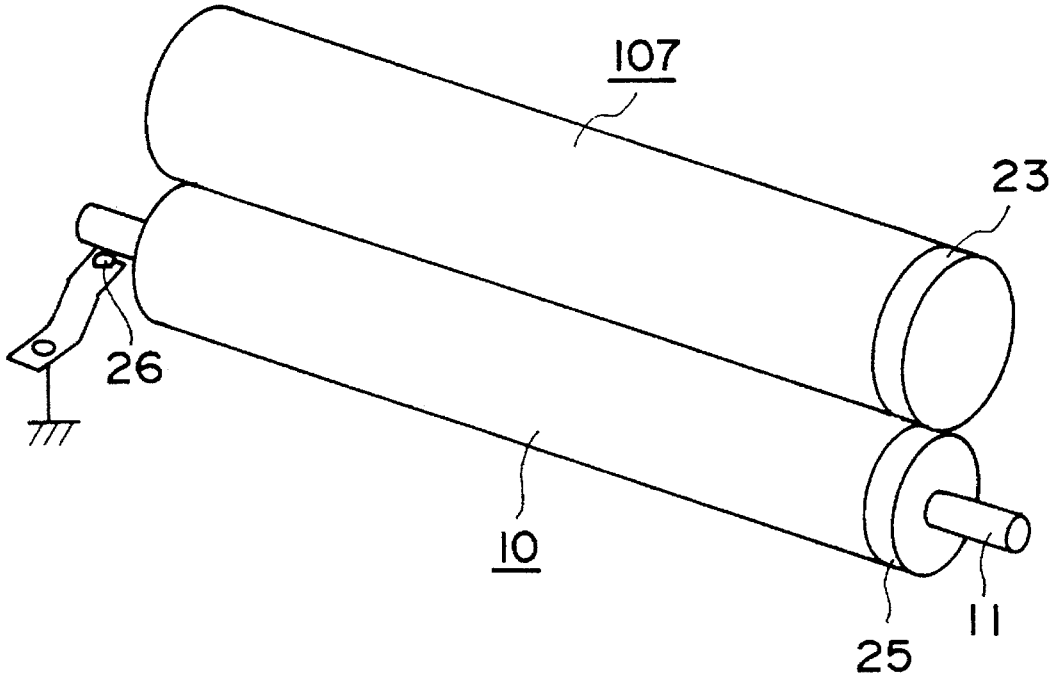
FIG. 9 illustrates electric connection in the film according to a further embodiment of the present invention.

FIG. 8 shows examples. An exposed portion 28 not covered with the surface parting layer adjacent an end of the film 107, is provided. The exposed portion 23 is contacted by a rubbing brush 24 of electrically conductive property, which is grounded.

The surface parting layer has a high resistance such as $10^8$–$10^{11}$ Ω/□, and therefore, the brush 24 may be directly contacted to the surface parting layer.

Figure 7:
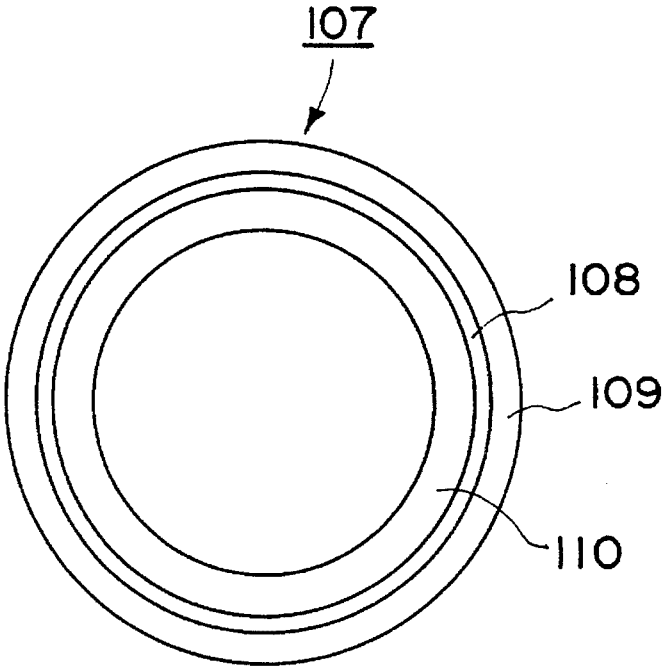
FIG. 7 is a sectional view of a heating film according to a further object of the present invention.

FIG. 7 shows another example.

A ring 25 of electroconductive rubber is attached to the pressing roller 10, and it is press-contacted to the exposed, portion of the film end portion 107, thus establishing electric contact. A metal shaft 11 is grounded by way of electrically conductive bearing or carbon chip contact 26. The exposed portion 23 of the primer layer can be provided by changing dipping depth when the film base is coated with primer layer and the parting layer through dipping method. When a spray application process is used, a mask is used upon application of the parting layer.

In the foregoing embodiment, Rion Baste W-310A was used as the conductive carbon black material, having the average particle size of 0.3 μm. When, however, Ketjen Black EC (available from AKZO), is used, the average particle size is 0.03 μm, and therefore, the same advantageous effects are provided with smaller content. Furthermore, if Ketjen Black EC 600ZD (available from AKZO) is used, the content thereof can be further reduced. Thus, the coagulation of the application liquid is prevented, thus stabilizing the dispersion. Therefore, the electroconductivity and resistance of the primer layer and the parting layer are stabilized, and therefore, the mass-production is easy.

The parting property of the film parting layer is deteriorated with increase of carbon content. However, a high resistance can be provided without reduction of the parting property if the Ketjen Black is used.

Table 2 shows the proper quantity of Ketjen Black EC and EC600JD for the primer layer and the parting layer.

TABLE 2

| | Ketjen Black EC | Ketjen Black EC600JD |
|---|---|---|
| Primer Layer | 0.4–1.6 wt. % | 0.24–0.96 wt. % |
| Parting Layer | 0.16–0.4 wt. % | 0.1–0.25 wt. % |

A resistor, barrister, diode or the like may be placed between the primer layer and the ground to protect the glass protection layer for the heater from whole formation upon thunder surge or the like on the AC current applied to the heater. It is possible that the primer layer is caused to retain the electric charge of the same polarity of the toner depending on the direction of the diode, thus increasing the offset preventing effect.

According to this embodiment, the influence to the outer peripheral surface due to the friction charge potential on the inside surface of the film and the heater, can be shielded, thus preventing accumulation of the separation charge electric charge on the film surface and preventing the leakage of the transfer charge on the paper, so that the toner offset, the image scattering and the central transfer void can be prevented.

A further embodiment of the present invention will be described in which the film has a four layer structure.

Figure 10:
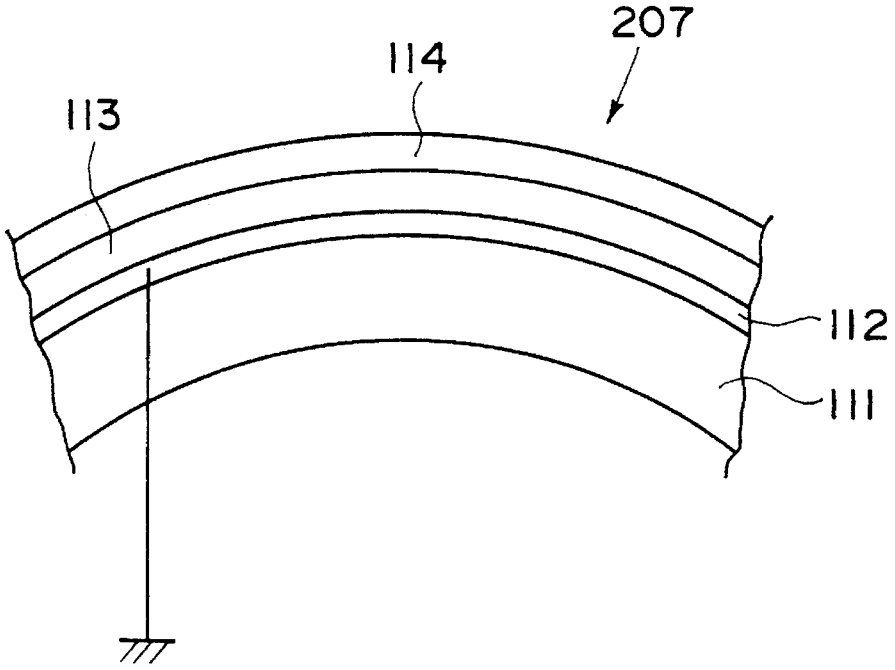
FIG. 10 is a partial sectional view of a heating film according to a further object of the present invention.

FIG. 10 is a sectional view illustrating a laminated structure of the fixing film 207. The insulative resin base 111 comprises heat resistive polyimide material having a thickness of 20–80 μm and a volume resistivity of $10^{11}$ Ω.cm or higher. On the base material 111, an insulative intermediate layer 113 having a thickness of 5–8 μm is bonded by a primer layer 112 which is an mixture of carbon, PES and PFA and having a thickness of 3–8 μm and a surface resistance of $10^7$ Ω/□ or less, the intermediate layer 113 comprises fluorine resin or silicone resin such as PFA or PTFE having a good insulative and parting properties and having a withstand voltage of not less than 30 V.

A parting layer 114 having a thickness of 3–5 μm and comprising fluorine resin or silicone rubber resin in which 1–4% by weight of carbon black (solid component) is dispersed, is bonded thereon.

The resin materials of the intermediate layer 113 and that of the parting layer 114 are preferably the same to improve the bonding strength.

The surface resistance of the parting layer is preferably $10^4$–$10^8$ Ω/□. If it is lower than $10^4$ Ω/□, the carbon content is too large with the result of deterioration of the parting property, and therefore, the toner offset is rather promoted. On the other hand, the next sheet to be processed is introduced before the electric charge produced by the separation charging is not sufficiently moved, and therefore, the toner offset is not prevented, if the surface resistance is larger than $10^8$ Ω/□.

For example, the polyimide film 111 having a volume resistivity of $10^{14}$ Ω/cm and a thickness of 45 μm may be coated by a primer 112 having a thickness of 4 μm and having a surface resistance of $5\times10^4$ Ω/□, a fluorine resin, as an intermediate insulative layer 113, having a thickness of 10 μm and comprising PFA (tetrafluoroethylene perfluorovinylether copolymer) and PTFE (20:80), and a sprayed outer parting layer comprising PFA and PTFE (20:80) and 20% by weight of carbon black (solid component ratio), and having a thickness of 5 μm, in the order named.

In this embodiment, the film base 111 in sliding contact with the heater is of insulative nature. This is because if the base member 111 contains electroconductive material to reduce the resistance in an attempt to lower the triboelectric charge potential on the inside surface of the film, the current may leak because the distance from the electric resistor material is very small.

If the thickness of the protection layer of the heater is increased in an attempt to solve the problem of the leakage, the quick-starting advantage is deteriorated. Therefore, the provision of the insulative base material 111 is effective to solve the problem of the leakage without deteriorating the quick-starting advantage.

However, the base member 111 is strongly charged to the positive polarity which is the opposite from that of the toner due to the friction charging with the heater or the like, and therefore, the charge potentials of the sliding surface of the film applies the electrostatic attraction force to the toner. In order to prevent this, the primer layer is electroconductive and is shielded.

The conductive primer layer 112 is electrically grounded. The intermediate insulative layer 113 is of fluorine resin in the form of a mixture of PFA and PTFE to reduce the number of pin holes of PTFE by PFA, thus increasing the volume resistivity of the parting layer, in order to prevent the leakage of the electric charge for retaining the toner on the sheet.

In the parting layer 114, 1–4% by weight of carbon black (Rion Paste W-310A, available from Rion Kabushiki Kaisha, Japan) (solid component ratio) is dispersed in the mixture of PFA and PTFE resin materials. The layer is electrically floated.

Here, the conductivity of the parting layer 114 is increased by the carbon black, metal powder, metal whisker or another conductive particles are usable in place thereof.

The electric charge generated on the surface of the parting layer 114 by the separation charge expands over the whole surface of the fixing film, and therefore, no local positive potential appears.

Since the parting layer 114 and the primer layer 112 constitute a large capacity capacitor, the surface potential does not exceeds several volt even if the electric charge produced by the separation charging is accumulated for a long period operation, and therefore, no offset is produced.

This is because, if the surface is charged to the positive polarity even to a slight extent, the electric field between the sheet and the fixing film is deteriorated so that the separation discharge is suppressed. Another reason is that the charge leaks, although the amount is small, through the intermediate insulative layer of the pressing roller.

Figure 11:
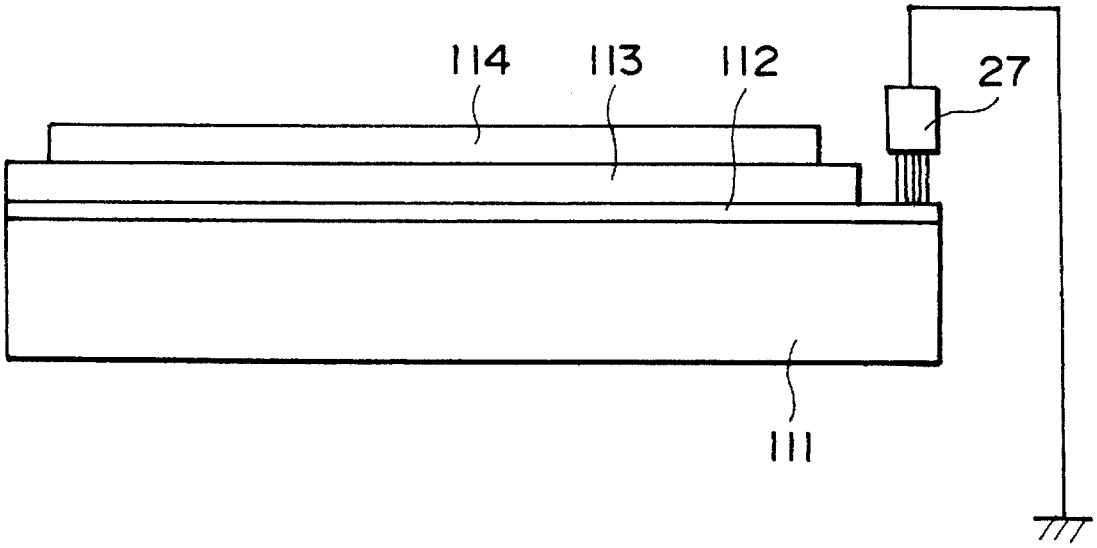
FIG. 11 illustrates electric connection in the film according to an embodiment of the present invention.

FIG. 11 shows a laminated structure in the actual direction of the fixing film, and illustrates the complete insulation of the surface parting layer 114 by the intermediate insulative layer 113. The conductive primer layer 112 is grounded through a conductive brush 27.

In the foregoing embodiment, the carbon black is dispersed in the parting layer 114. It is further preferable that the particle size of the carbon black is smaller.

In the case of the Rion Paste W-310A used in the foregoing embodiment, Ketjen Black EC having an average particle size of 0.3 μm is used. If this is replaced with Ketjen Black EC600JD having a particle size of 0.03 μm, the spaces between particles are smaller as shown in FIG. 12, (*a*), and therefore, the electric discharge easily occurs from the fluorine resin material filling the space, and as a result, the charging of the entirety of the film can be made uniform.

Figure 12A:
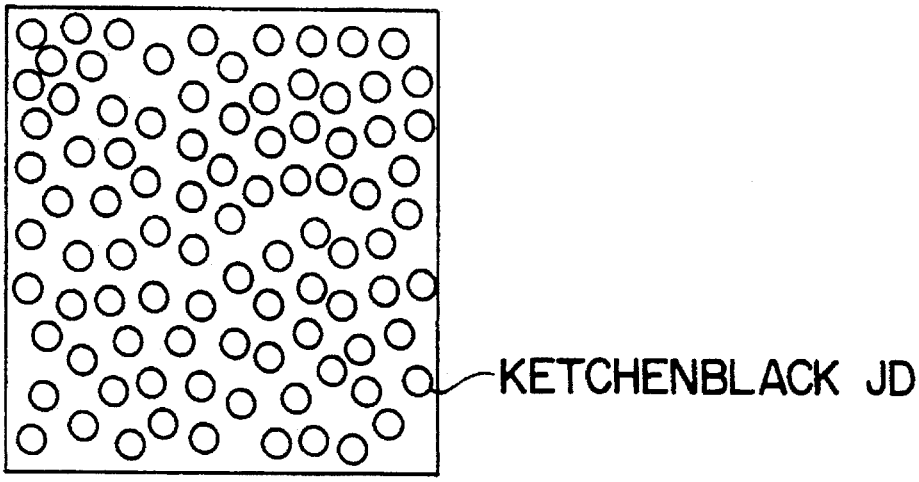
FIG. 12, which consists of FIGS. 12 (*a*) and (*b*), illustrates a parting layer of the film according to an embodiment of the present invention.
Figure 12B:
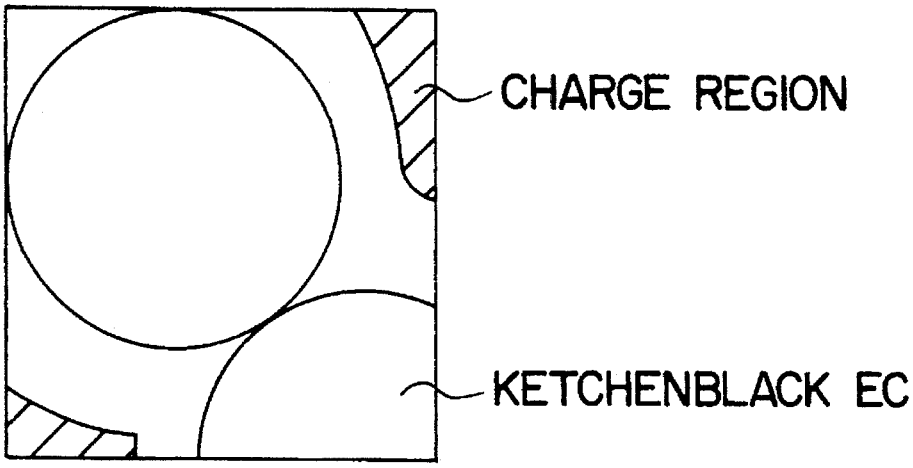

On the other hand, in the case of the conventional Ketjen Black EC, the spaces between particles are large, as shown in FIG. 12, (*b*), with the result of charging region without the electric discharge to the Ketjen Black EC particle on the surface of the fluorine resin material. Therefore, the potential appearing on the surface is more uniform with the Ketjen Black EC600JD than the other, and the offset prevention effect is better.

The similar advantageous effects are provided using other conductive particles having the particle size of approx. 0.03 μm.

Since the particle size of the Ketjen Black EC600JD is small, they are not easily bonded to several microns of the toner particles as compared with normal carbon black particles, and therefore, the reduction of the parting property tends to occur. If the same conductivity is to be given, 60% amount is sufficient, and therefore, it is good surface layer from the standpoint of the parting property.

In the foregoing embodiment, the ratio of PFA and PTFE in the parting layer and the insulative intermediate layer is 10:80. However, this is not limiting.

In place of PFA, FEP is usable.

The PFA and FEP materials function to increase the volume resistivity or the insulative property of the applied coating, and therefore, the mechanical strength can be increased by increasing the thickness of the intermediate layer and the parting layer and increasing the PTFE content.

By doing so, the resistivity against damage or wearing can be increased. The material of the film base is not limited to polyimide, but may be another film material such as glass cloth or another highly heat resistive material having high thermal conductivity.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

a heater; and a movable film having a first surface in contact with said heater and a second surface contactable with a recording material supporting a toner image;

the toner image on the recording material being heated by heat from said heater; and said film comprising an insulative base layer chargeable to a polarity opposite from that of the toner and having a volume resistivity of not less than $10^{11}$ Ω.cm and an electrically conductive layer, with a surface resistance of not more than $10^{7}$ Ω/□, at a position closer to said insulative base layer.

2. An apparatus according to claim 1, wherein said film is in sliding contact with said heater.

3. An apparatus according to claim 1, wherein said film has an insulative particle layer contactable with the toner image.

4. An apparatus according to claim 3, wherein said conductive layer functions also as a primer layer for bonding said insulative base layer with said insulative parting layer.

5. An apparatus according to claim 3, wherein a volume resistivity of said insulative parting layer is not less than $10^{11}$ Ω.cm.

6. An apparatus according to claim 3, wherein said insulative parting layer has a charging property which is the same as that of the toner.

7. An apparatus according to claim 1, wherein said film has a primer layer between said insulative base layer and said conductive layer for bonding them with each other.

8. An image heating apparatus, comprising:

a heater; and a movable film having a first surface in contact with said heater and a second surface contactable with a recording material supporting a toner image;

the toner image on the recording material being heated by heat from said heater; and said film comprising an insulative base layer chargeable to a polarity opposite from that of the toner and an electrically conductive layer at a position closer to said insulative base layer, wherein said conductive layer is electrically grounded.

9. An apparatus according to claim 8, wherein said conductive layer is electrically grounded through a rectifying element.

10. An image heating apparatus, comprising:

a heater;

a movable film having a first surface in contact with said heater and a second surface contactable with a recording material supporting a toner image;

the toner image on the recording material being heated by heat from said heater;

said film comprising an insulative base layer contactable with said heater and an insulative parting layer contactable with the toner image and an electrically conductive layer between said insulative base layer and said insulative parting layer.

11. An apparatus according to claim 10, wherein said conductive layer functions also as a primer layer for bonding said insulative base layer with said insulative parting layer.

12. An apparatus according to claim 10, wherein said insulative base layer and said insulative parting layer have a volume resistivity of not less than $10^{11}$ Ω.cm, and said conductive layer has a surface resistance of not more than $10^7$ Ω/□.

13. An apparatus according to claim 10, wherein said electrically conductive layer is electrically grounded.

14. A heating film comprising:

an insulative base layer;

an insulative parting layer; and an electrically conductive layer between said insulative base layer and said insulative parting layer.

15. A heating film according to claim 14, wherein said conductive layer functions also as a primer layer for bonding said insulative base layer with said insulative parting layer.

16. A heating film according to claim 14, wherein said insulative base layer and said insulative parting layer have a volume resistivity of not less than $10^{11}$ Ω.cm, and said conductive layer has a surface resistance of not more than $10^7$ Ω/□.

17. An image heating apparatus, comprising:

a heater;

a movable film having a first surface in contact with said heater and a second surface contactable with a recording material;

wherein an image on the recording material is heated by heat from said heater;

said film comprising an insulative base layer in contact with said heater, a surface parting layer contactable with a recording material and comprising low resistance material, and an electrically conductive layer between said insulative base layer and surface parting layer and having a surface resistance smaller than that of said surface parting layer.

18. An apparatus according to claim 17, wherein said surface parting layer comprises a surface resistance of not less than $10^8$ Ω/□ and not more than $10^{11}$ Ω/.

19. An apparatus according to claim 17, wherein said conductive layer has a surface resistance of not more than $10^7$ Ω/□.

20. An apparatus according to claim 17, wherein said conductive layer functions as a primer layer for bonding said insulative base layer with said surface parting layer.

21. An apparatus according to claim 17, wherein said conductive layer is electrically grounded.

22. An apparatus according to claim 17, further comprising a pressing member far pressing said heater through said film, and said conductive layer being electrically grounded through said pressing member.

23. An apparatus according to claim 17, wherein said film is in sliding contact with said heater.

24. An apparatus according to claim 17, wherein a volume resistivity of said insulative base layer is not less than $10^{11}$ ohm.cm.

25. A heating film comprising:

an insulative base layer;

a surface parting layer containing low resistance material; and an electrically conductive layer between said insulative base layer and said surface parting layer and having a surface resistance smaller than that of said surface parting layer.

26. A heating film according to claim 25, wherein said surface parting layer comprises a surface resistance of not less than $10^8$ Ω/□ and not more than $10^{11}$ Ω/□.

27. A heating film according to claim 25, wherein said conductive layer has a surface resistance of not more than $10^7$ Ω/□.

28. A heating film according to claim 25, wherein said conductive layer functions as a primer layer for bonding said insulative base layer with said surface parting layer.

29. An apparatus according to claim 25, wherein a volume resistivity of said insulative base layer is not less than $10^{11}$ ohm.cm.

30. An image heating apparatus, comprising:

a heater;

a film having a first surface in contact with said heater and a second surface contactable with the recording material;

wherein an image on said recording material is heated by heat from said heater;

said film comprising an insulative base layer, an electrically conductive layer, an insulative intermediate layer and an electrically conductive parting layer contactable with the recording material, in the order named from said heater.

31. An apparatus according to claim 30, wherein a surface resistance of said conductive parting layer is not less than $10^4$ Ω/□ and not more than $10^8$ Ω/□.

32. An apparatus according to claim 30, wherein said film is in sliding contact with said heater.

33. An apparatus according to claim 30, wherein a volume resistivity of said insulative base layer is not less than $10^{11}$ ohm.cm.

34. An apparatus according to claim 30, wherein a surface resistance of said electrically conductive layer is not more than $10^7$ ohm/□.

35. An apparatus according to claim 30, wherein said electrically conductive layer is electrically grounded.

36. A heating film comprising:

an insulative base layer;

an electrically conductive parting layer;

an electrically conductive layer between said insulative base layer and said electrically conductive parting layer; and an insulative intermediate layer between said electrically conductive layer and said electrically conducting parting layer.

37. An apparatus according to claim 36, wherein a volume resistivity of said insulative base layer is not less than $10^{11}$ ohm.cm.

38. An apparatus according to claim 36, wherein a surface resistance of said electrically conductive layer is not more than $10^7$ ohm/□.

39. An apparatus according to claim 36, wherein a surface resistance of said electrically conductive parting layer is not less than $10^4$ and not more than $10^8$ ohm/□.

* * * * *

UNITED STATES PATENT AND TRADEMARK OFFICE

CERTIFICATE OF CORRECTION

PATENT NO. : 5,471,288

DATED : November 28, 1995

INVENTOR(S) : YASUMASA OHTSUKA, ET AL.

It is certified that error appears in the above-indentified patent and that said Letters Patent is hereby corrected as shown below:

Title page,

Item [57] ABSTRACT, line 8, "the" (first occurrence) should read --that--.

Column 1, line 16, "passes" should read --passed--; and line 45, "exist" should read --exists--.

Column 2, line 7, "Offset" should read --offset--.

Column 3, line 49, "That" should read --that--.

Column 4, line 4, "F)." should read --P).--;

line 23, "G" should be deleted; and line 47, "$10^{14}$ .cm" should read --$10^{14}$ Ω.cm--.

Column 5,

Table 1, "slight offset" should read --Slight offset--; and line 62, "show" should read --shown--.

Column 7, line 38, "tile" should read --the--.

Column 8, line 5, "will" should read --will be--.

Column 9, line 23, "exposed," should read --exposed--.

UNITED STATES PATENT AND TRADEMARK OFFICE

CERTIFICATE OF CORRECTION

PATENT NO. : 5,471,288

DATED : November 28, 1995

INVENTOR(S) : YASUMASA OHTSUKA, ET AL.

It is certified that error appears in the above-indentified patent and that said Letters Patent is hereby corrected as shown below:

Column 10,
line 14, "an" should read --a--.

Column 13,
line 51, "$10^{11}$ Ω/." should read --$10^{11}$ Ω/□.--.

Column 14,
line 55, "conducting" should read --conductive--.

Signed and Sealed this

Ninth Day of April, 1996

Bruce Lehman

BRUCE LEHMAN

*Commissioner of Patents and Trademarks*

*Attest:*

*Attesting Officer*